US006709130B2

(12) United States Patent
Behr et al.

(10) Patent No.: US 6,709,130 B2
(45) Date of Patent: Mar. 23, 2004

(54) INCANDESCENT LAMP FOR MOTOR VEHICLE HEADLAMPS

(75) Inventors: Gerhard Behr, Altheim (DE); Peter Helbig, Sontheim (DE); Christian Seichter, Herbrechtingen (DE)

(73) Assignee: Pätent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 38 days.

(21) Appl. No.: 10/241,471

(22) Filed: Sep. 12, 2002

(65) Prior Publication Data

US 2003/0053309 A1 Mar. 20, 2003

(30) Foreign Application Priority Data

Sep. 14, 2001 (DE) ..... 101 45 427

(51) Int. Cl.[7] ..... F21K 2/00

(52) U.S. Cl. ..... 362/214; 362/508; 362/539; 313/580; 313/272

(58) Field of Search ..... 362/214, 211, 362/507, 508; 313/578, 580, 272, 273, 315, 316

(56) References Cited

U.S. PATENT DOCUMENTS

| | | | | |
|---|---|---|---|---|
| 3,858,086 A | * | 12/1974 | Anderson et al. | 315/49 |
| 4,480,296 A | * | 10/1984 | Gagnon et al. | 362/519 |
| 5,725,298 A | | 3/1998 | Kalze et al. | |
| 5,856,723 A | * | 1/1999 | Rittner | 313/117 |
| 6,612,727 B2 | * | 9/2003 | Nouet | 362/508 |

FOREIGN PATENT DOCUMENTS

| | | | | |
|---|---|---|---|---|
| EP | 0791779 | * | 2/1997 | 3/8 |

* cited by examiner

*Primary Examiner*—Sandra O'Shea
*Assistant Examiner*—Ali Alavi
(74) *Attorney, Agent, or Firm*—William E. Meyer

(57) ABSTRACT

The invention relates to a double-filament halogen incandescent lamp for a motor vehicle headlamp. In order to reduce the light shading effects caused by the filament holder, at least one of the power supply wires (8) is provided with a section **(8*a*) that projects out of the common plane of the power supply wires (7, 8, 9) and is guided past the main filament (5), this section (8*a*) being shaped such that light beams that are emitted by the main filament (5) perpendicular to its filament axis are not obstructed by the power supply wire (8)**.

6 Claims, 3 Drawing Sheets

INCANDESCENT LAMP FOR MOTOR VEHICLE HEADLAMPS

I. TECHNICAL FIELD

Figure 1:
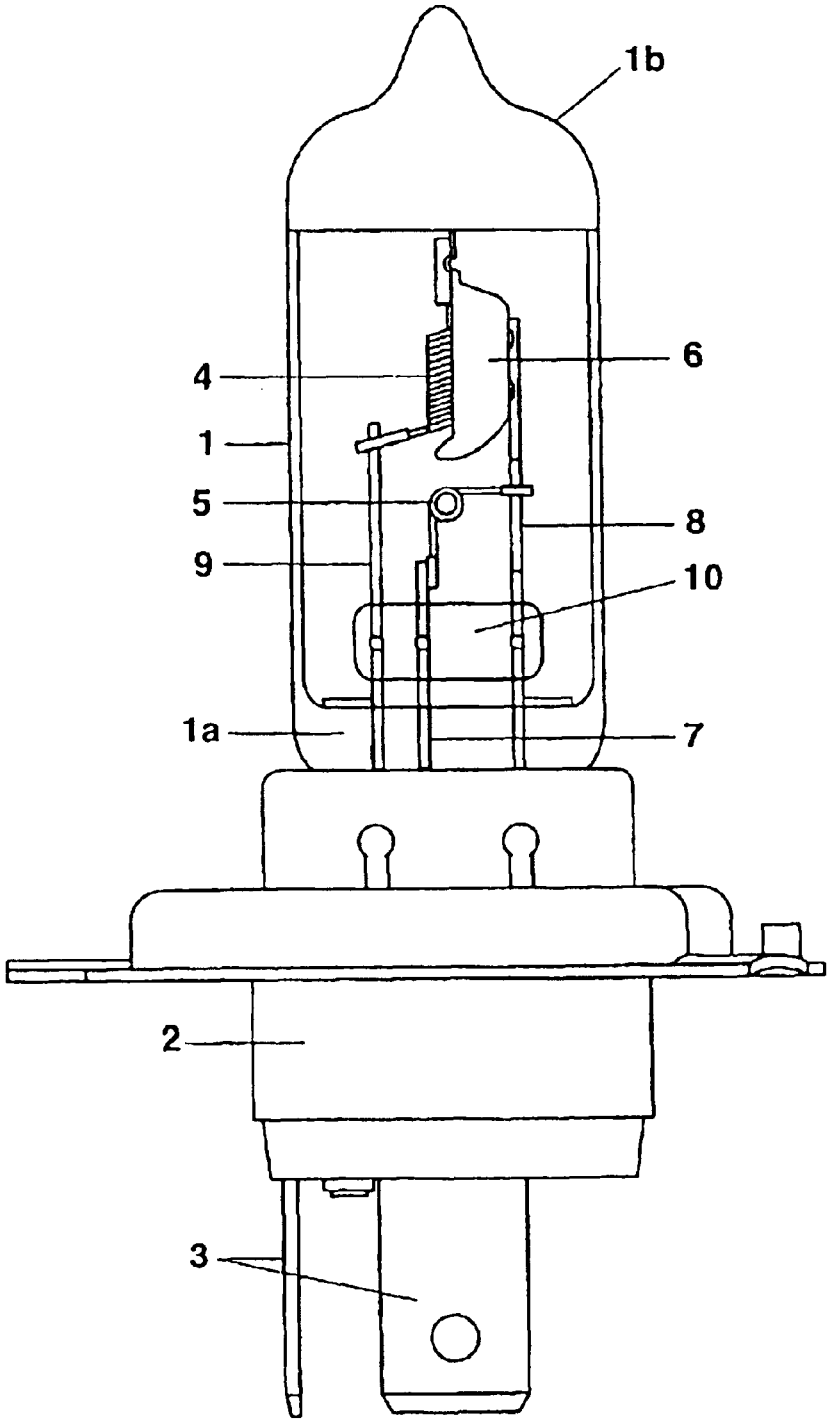

The invention relates to an incandescent lamp for a motor vehicle headlamp in accordance with the preamble of patent claim 1.

II. BACKGROUND ART

Such an incandescent lamp is disclosed, for example, in European laid-open specification EP 0 791 779. This publication describes a motor vehicle headlamp having a double-filament halogen incandescent lamp that has an axially symmetrical lamp vessel with an incandescent filament aligned axially therein, and an incandescent filament aligned transversely, as well as a shading device for the axial filament.

III. DISCLOSURE OF THE INVENTION

It is the object of the invention to provide an incandescent lamp having an improved frame design. The aim, in particular, is to ensure that the light emission of the incandescent filaments is obstructed as little as possible by their supply leads, and that shading effects in the principal light emission direction of the incandescent filaments through the supply leads are reduced.

This object is achieved according to the invention by the features of patent claim 1. Particularly advantageous embodiments of the invention are described in the dependent claims.

In the case of the incandescent lamp according to the invention, the frame that serves to hold and supply power to the incandescent filaments is designed in such a way that at least one power supply wire, preferably the power supply wire serving to hold the shading device, has a section that projects out of the common plane of the power supply wires and is guided past the transversely aligned incandescent filament and is shaped in such a way that it is arranged outside the principal light emission direction of the second incandescent filament. By principal light emission direction is meant the directions running perpendicular to the longitudinal axis of the transversely aligned incandescent filament. Instead of this, the above-named power supply wire is guided past the transversely aligned incandescent filament such that light beams that this incandescent filament emits perpendicular to its longitudinal axis cannot strike the above-named power supply wire. For this purpose, this power supply wire has a section that projects out of the common plane of the power supply wires and is guided past the transversely aligned incandescent filament, and is shaped or arranged in such a way that it is not struck by light beams that this incandescent filament emits perpendicular to its longitudinal axis. If the motor vehicle headlamp predominantly uses only the downwardly emitted light fraction of the transversely aligned incandescent filament, it is sufficient that only the power supply wire supporting the shading device is guided past the transversely aligned incandescent filament, in order distinctly to reduce the shading effects owing to the frame, and appreciably to increase the useful fraction of the light emitted by the transverse filament. If the motor vehicle headlamp makes predominant use only of the upwardly emitted light fraction of the transversely aligned incandescent filament, it is sufficient that only the power supply wire connected to the axially aligned incandescent filament—that is to say the incandescent filament aligned parallel to the lamp vessel axis—is guided past the transversely aligned incandescent filament, in order distinctly to reduce the shading effects owing to the frame, and appreciably to increase the useful fraction of the light emitted by the transverse filament. The shading effects can be diminished most strongly when both abovementioned power supply wires are guided past the transverse filament.

The frame design according to the invention is also distinguished, furthermore, by a particularly simple construction. The three power supply wires are fixed in a common plane perpendicular to the longitudinal axis of the incandescent filament aligned transversely with reference to the lamp vessel axis. The purpose of holding and making electrical contact with the transversely aligned incandescent filament is advantageously served by the section, projecting out of the common plane, of the power supply wire supporting the shading device, and by a bent end, projecting out of the common plane, of the first power supply wire. The ends of the transversely aligned incandescent filament need not therefore be bent in order to produce a connection with its power supply wires. The resistance of the lamp or the filament holder to vibration is thereby increased.

The section, projecting out of the common plane of the power supply wires, of the power supply wire supporting the shading device is advantageously of substantially trapezoidal construction, and the end of this section is advantageously arranged obliquely relative to the lamp vessel axis and welded to the shading device. As a result, only three bending points are required in order for the power supply wire supporting the shading device to be guided past the transversely aligned incandescent filament.

The shape of the shading device for the axial filament has likewise been improved. On its side facing the axially aligned incandescent filament, it has an elevation in order to be able to weld the end of this incandescent filament more easily to the shading device. Moreover, the shading device has a slightly curved shader nose that extends into the interspace between the two incandescent filaments. The width of the shader nose advantageously corresponds to the length of the light-emitting part of the transverse filament, in order largely to avoid mutual influencing of the light emission of the two incandescent filaments. The side of the shading device averted from the axial filament is advantageously provided with one or more projections running obliquely relative to the lamp vessel axis, in order to ensure a reliable welded joint between the shading device and the power supply wire supporting it.

III. BRIEF DESCRIPTION OF THE DRAWINGS

Figure 2:
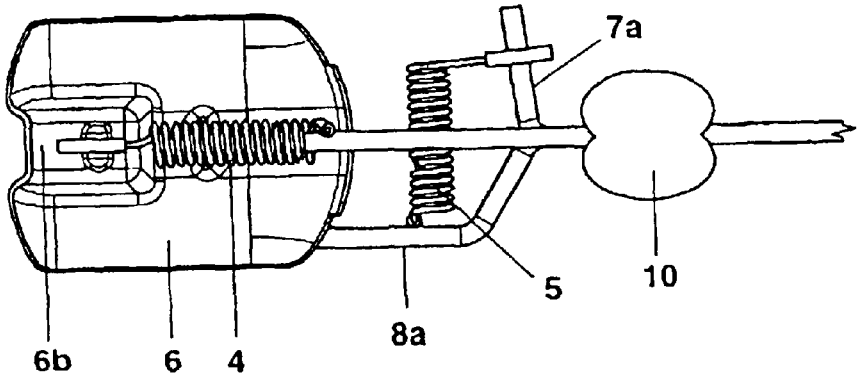
Figure 3:
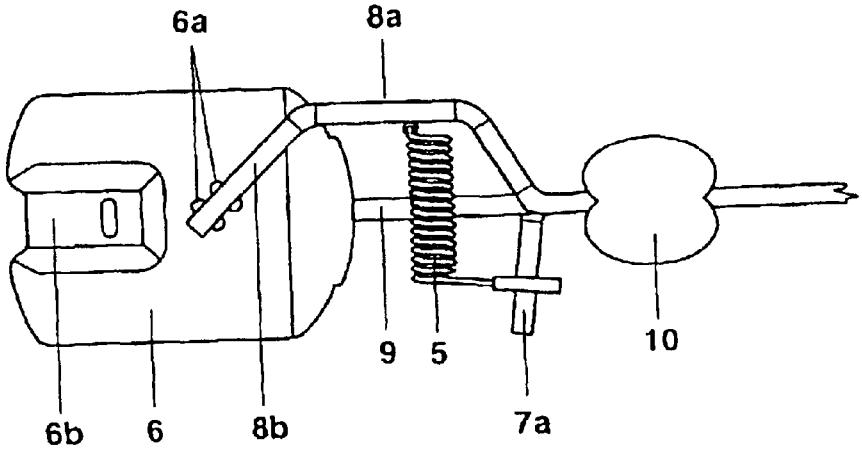
Figure 4:
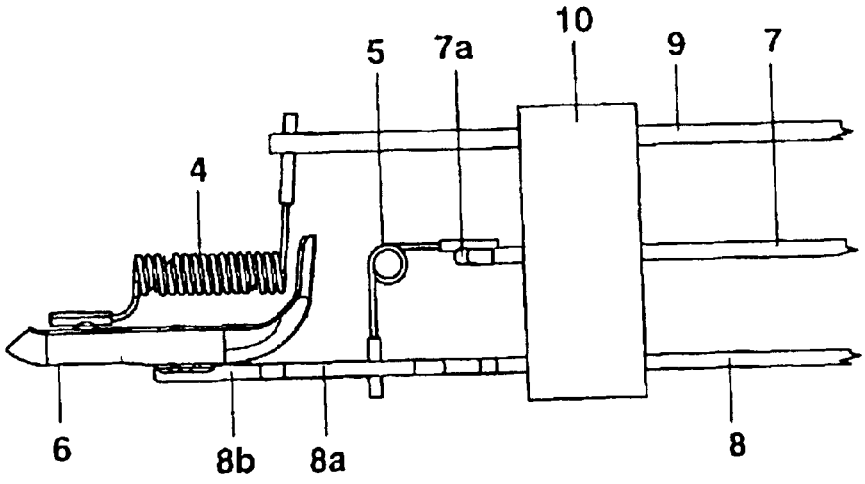
Figure 5:
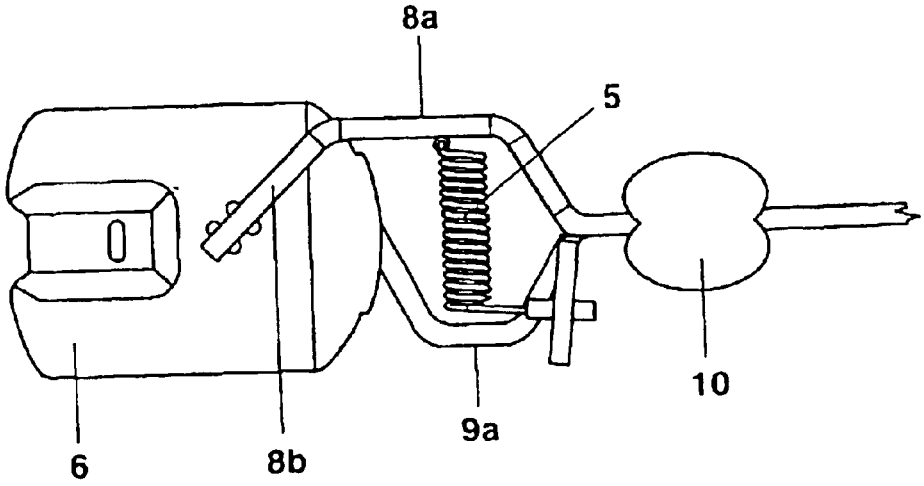

The invention is explained below in more detail with the aid of two preferred exemplary embodiments. In the drawings:

FIG. 1 shows a side view of an incandescent lamp in accordance with the first exemplary embodiment of the invention, in a schematic illustration, FIG. 2 shows a schematic plan view of the top side of the frame and the incandescent filaments of the lamp illustrated in FIG. 1, FIG. 3 shows a plan view of the underside of the frame shown in FIG. 2, FIG. 4 shows a side view of the frame illustrated in FIGS. 2 and 3, FIG. 5 shows a bottom view of the frame in accordance with the second exemplary embodiment of the invention.

IV. BEST MODE FOR CARRYING OUT THE INVENTION

The incandescent lamp according to the invention and illustrated in FIG. 1 is a double-filament halogen incandescent lamp that is provided for use in a motor vehicle headlamp. The incandescent lamp according to the invention has a glass, substantially axially symmetrical lamp vessel 1 that is sealed in a gastight fashion by means of a pinch seal 1*a*. The dome of the lamp vessel 1 is provided with an opaque coating 1*b*. The pinch seal 1*a* is fixed in the lamp base 2, which is fitted with three electrical terminals 3. Arranged inside the lamp vessel 1 are a first incandescent filament 4, aligned axially with reference to the lamp vessel axis, and a second incandescent filament 5, aligned transverse to the lamp vessel axis. The first incandescent filament 4 is partially surrounded by a shading device 6 that is also termed anti-dazzle device 6 below. It serves the purpose of producing the passing beam or the daytime driving light in a motor vehicle, parallel to the lamp vessel axis. It is welded to the end of the first incandescent filament 4 near the base. The other end of the first incandescent filament 4 is welded to the upper side, facing it, of the anti-dazzle device 6. For this purpose, the top side of the anti-dazzle device 6 is provided with an elevation 6*b* to which this incandescent filament end is connected by projection welding.

FIG. 5 shows details of the frame design in accordance with the second exemplary embodiment of the invention. This exemplary embodiment differs from the first exemplary embodiment described above only in terms of the shaping of the third power supply wire connected to the end of the transversely aligned incandescent filament near the base. For this reason, the same reference numerals are used in FIG. 5 for identical parts as in FIGS. 1 to 4, which illustrate the first exemplary embodiment of the invention. In accordance with the second exemplary embodiment, the third power supply wire 9 likewise has a substantially trapezoidally shaped section 9*a* that is guided past the second incandescent filament 5 in such a way that the light beams emitted by this incandescent filament 5 perpendicular to its longitudinal axis are not shaded by this power supply wire 9. The second exemplary embodiment corresponds in all other details to the first.

The invention is not limited to the exemplary embodiments explained in more detail above. For example, it is also possible to use a hard glass beam instead of the quartz beam 10. However, it is also possible to produce the frame according to the invention without such a beam. A metal bridge whose webs are later severed for the purpose of electrical isolation of the power supply wires can also serve as starting point for fabricating the frame.

What is claimed is:

1. An incandescent lamp for motor vehicle headlamps, having a substantially axially symmetrical lamp vessel, a first incandescent filament, aligned axially in the lamp vessel, a second incandescent filament, aligned transversely in the lamp vessel, a frame for holding and making electrical contact with the incandescent filaments, which has a shading device for the first incandescent filament and three power supply wires, wherein the three power supply wires are arranged in a common plane perpendicular to the longitudinal axis of the second incandescent filament, and at least one power supply wire has a section that projects out of the common plane and is guided past the second incandescent filament and is shaped in such a way that it is arranged outside the principal light emission direction of the second incandescent filament.

2. The incandescent lamp as claimed in claim 1, wherein the section projecting out of the common plane and guided past the second incandescent filament is of substantially trapezoidal construction.

3. The incandescent lamp as claimed in claim 1, wherein the end (8*b*) of the section projecting out of the common plane and guided past the second incandescent filament runs obliquely relative to the lamp vessel axis and is connected to the side of the shading device averted from the first incandescent filament.

4. The incandescent lamp as claimed in claim 1, wherein the second end of the second incandescent filament is connected to the section projecting out of the common plane and guided past the second incandescent filament.

5. The incandescent lamp as claimed in claim 1, wherein on the side facing the first incandescent filament the shading device has an elevation that is connected to the second end of the first incandescent filament.

6. The incandescent lamp as claimed in claim 1, wherein the first power supply wire has a bent section that projects out of the common plane and is connected to the first end of the second incandescent filament.

* * * * *